US006036395A

United States Patent [19]

Dalle Rose

[11] Patent Number: 6,036,395

[45] Date of Patent: Mar. 14, 2000

[54] NOTEBOOK ORGANIZERS

[76] Inventor: Leonardo Dona Dalle Rose, 1815 JFK Blvd., Apt. 1613, Philadelphia, Pa. 19103

[21] Appl. No.: 09/191,148

[22] Filed: Nov. 13, 1998

[51] Int. Cl.[7] ..... B42F 3/00

[52] U.S. Cl. ..... 402/70; 281/21.1; 281/23; 281/38; 281/45; 402/60; 402/79; 402/500

[58] Field of Search ..... 281/21.1, 23, 38, 281/45, 9, 12, 14, 28; 402/79, 60, 500, 70

[56] References Cited

U.S. PATENT DOCUMENTS

| | | | |
|---|---|---|---|
| 4,127,690 | 11/1978 | Schleifenbaum et al. | 428/40 |
| 4,892,192 | 1/1990 | Hague, Sr. et al. | 206/425 |
| 4,937,588 | 6/1990 | Hanson et al. | 412/4 |
| 4,973,184 | 11/1990 | La Salle | 402/70 |
| 5,169,254 | 12/1992 | Arkwright | 402/8 |
| 5,294,208 | 3/1994 | Tremmel, Jr. et al. | 402/70 |
| 5,575,503 | 11/1996 | Takahashi | 281/21.1 |
| 5,713,604 | 2/1998 | Ward, Jr. | 281/21.1 |
| 5,785,446 | 7/1998 | Dlugos | 402/79 |

FOREIGN PATENT DOCUMENTS

MI 95/0306 U 5/1995 Italy .

*Primary Examiner*—Andrea L. Pitts
*Assistant Examiner*—Monica Smith
*Attorney, Agent, or Firm*—Ratner & Prestia

[57] ABSTRACT

A reusable adhesive based notebook organizer that conveniently holds loose notes, papers and other similar items within the notebook is disclosed.

16 Claims, 2 Drawing Sheets

NOTEBOOK ORGANIZERS

FIELD OF THE INVENTION

The present invention relates to devices used to organize notebooks or notebook-type agendas. More particularly this invention relates to an organizer comprising a separable and reusable adhesive strip for use in multi-ring notebooks to hold loose notes, papers and similar items.

BACKGROUND OF THE INVENTION

The use of schedulers, diaries and agendas within the professional community has become ubiquitous. Even with the introduction and expanded use of miniaturized, or hand-held computer schedulers, many people prefer to use a hardcopy, hand written notebook. Indeed, an entire business field has been created to fill the expanding demand for notebook type schedulers and diaries. An example of a company providing a wide array and portfolio of such products is Day-Timer®, Inc.

While users of notebook type schedulers and agendas can write various entries and notes, including meeting minutes and appointments in their notebooks, all too often users also accumulate loose notes, business cards and other pieces of paper during each day. These loose notes are simply placed into the agenda in no particular order or means of being maintained and displayed. Because these notes, cards and papers are generally small and loose, they may fall out and be lost.

Various means of holding such notes in an agenda have been attempted without success. Indeed, the use of paperclips, adhesive tape, and the equally omnipresent use of Post-It® notes are all available to users of notebooks. Three examples of patented inventions within the United States that disclose the ability to hold or organize notes include U.S. Pat. No. 5,294,208 (Tremmel, Jr., et al.) teaching a Notebook-type Personal Organizer; U.S. Pat. No. 4,973,184 (La Salle) providing a Writing Pad Organizer; and U.S. Pat. No. 4,892,192 (Hague, Sr., et al.) disclosing a Coupon Organizer.

More specifically, the '208 patent describes an organizer comprising a multi-ring binder using a pad of adhesive paper sheets, similar to Post-It® notes, that permit the user to write a note on the paper sheets and thereafter place, reposition or otherwise use the note/paper sheet. However, there is no disclosure of how to organize, retain or hold loose notes other than the included adhesive paper sheets.

The '184 patent discloses an organizer having a back and front flap connected at a spine therebetween. To provide the "organization" capability, the back flap has a plurality of file folders, while the front flap has a plurality of separate note pads. The note pad sheets may be removed and adhered to the file folders where desired. Similar to the other described prior art, the '184 patent does not address or resolve the need the maintain loose notes in an accessible and observable location in the organizer.

Finally, the Coupon Organizer disclosed in the '192 patent uses a box-shaped housing into which coupons or potentially other loose notes could be placed. The '192 patent does not address the issue of maintaining the loose notes in an observable location. Moreover, and more important, the '192 patent does not teach use of the organizer for a ring-type notebook or agenda. The device is solely limited for use within a box mechanism.

The current inventor is also the owner of Italian Patent No. MI 95/U000306, issued May 5, 1995, for a specialized device equipped with a strip studded with perforations and containing an adhesive and protected supplementary strip, suitable for assuring an orderly arrangement of sheets of paper in loose-lead binders and similar filing devices. While Italian Patent No. MI 95/U000306 is a very useful tool, it uses a protective strip with adhesive qualities and does not incorporate a tab means to permit ease of separating the top and bottom sections of the strip. The device taught by Italian Patent No. MI 95/U000306 is improved upon by the present invention having a protective strip without any adhesive and with a tab means incorporated into the top section of the strip.

While each of the above inventions is patented, none is known to be available or widely used in the notebook/agenda market. Each of these devices exhibits certain deficiencies making its everyday and widespread use impracticable or inefficient. Indeed, the fact that none of these inventions has made its way into the mainstream market is testimony to the lack of practical utility of these devices. The various deficiencies or problems exhibited by each of these devices are intended to be overcome and solved by the present invention.

In view of this prior art, including the Dona Della Rose Italian patent, it would be desirable to have a simple and efficient device that can reusably hold loose notes, pieces of paper and similar items within a ring-type notebook scheduler or agenda. Such a device and results have not been achieved in the relevant art.

SUMMARY OF THE INVENTION

The above noted problems inadequately or incompletely resolved by the prior art are addressed and resolved by the present invention.

In a preferred aspect of the invention, the notebook organizer is a device to organize and hold loose papers in ring-type notebooks and binders, said device comprising an elongated body piece folded approximately in half, thereby defining a bottom and top segment; said bottom segment having a extended side segment with a plurality of holes punched therein through which the notebook rings fit; adhesive means applied to the side of the bottom segment facing the top segment; adhesive means applied to the side of the top segment facing the bottom segment; protective means removably inserted between the adhesive side of the bottom segment and adhesive side of the top segment; and a tab incorporated into the top segment to permit ease of separation of the top segment from the bottom segment.

In another preferred embodiment of the present invention, the organizer can be fabricated from a flat and flexible polymer material or plastic material.

In other preferred aspects of the present invention, the organizer can be manufactured to fit into binders having operable rings of two, three or more rings.

In yet another preferred embodiment of the present invention, the organizer may be printed or embossed with an ornamental design.

The invention will be best understood by reading the following detailed description of the preferred embodiments in conjunction with the drawings briefly described below.

BRIEF DESCRIPTION OF THE DRAWINGS

For the purpose of illustrating the invention, the attached drawings show several embodiments that are presently preferred. However, it should be understood that the invention is not limited to the precise arrangement and instrumentality shown in the accompanying drawings.

DETAILED DESCRIPTION OF PREFERRED EMBODIMENTS

The present invention is an organizer used to conveniently hold and display loose papers and similar items in place where the user desires such items to be held within a notebook. As designed, the organizer allows the user to place such loose papers and notes in the notebook where they are readily observable and also easily repositionable or easily removable.

Figure 1:
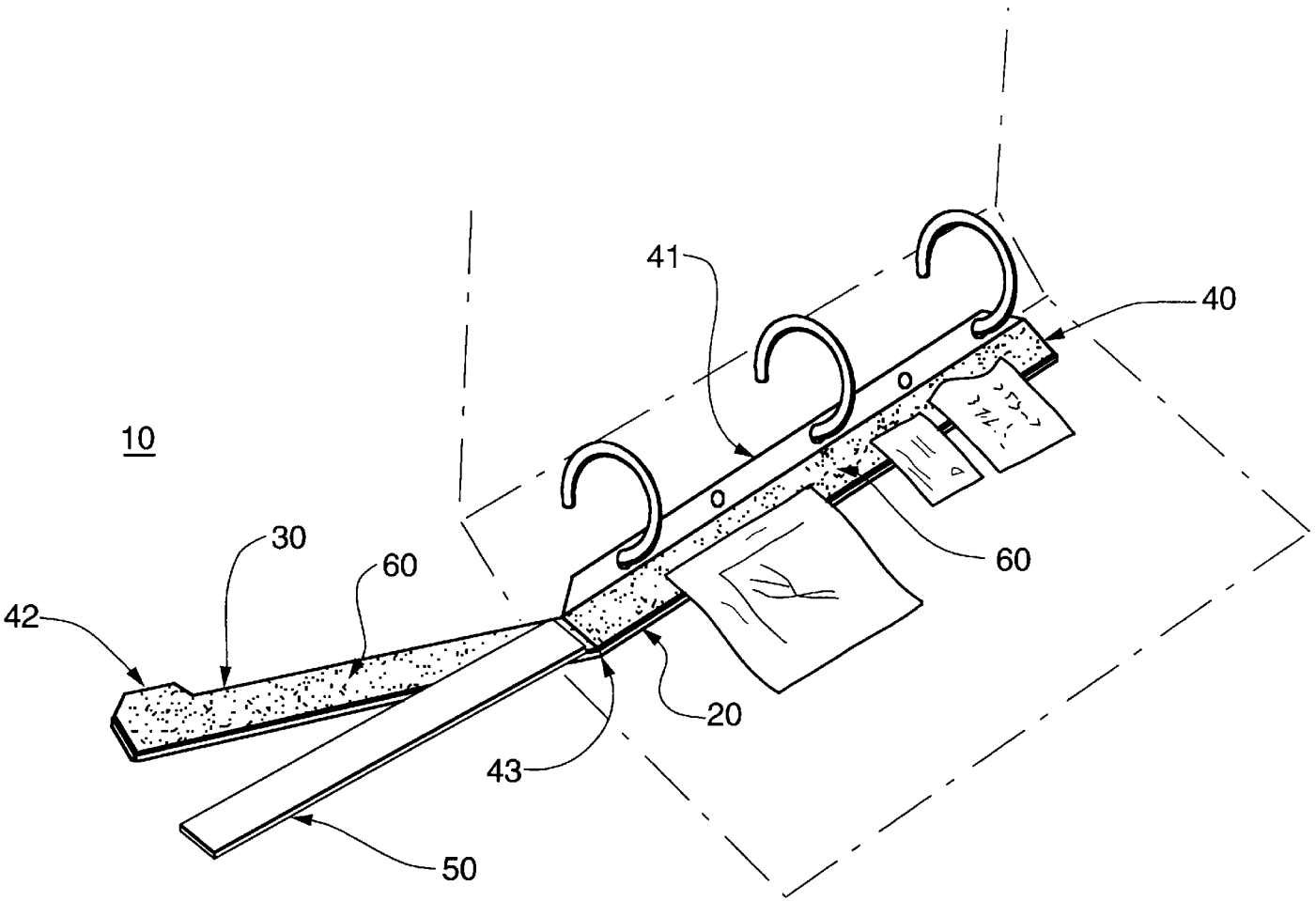
FIG. 1: is a perspective view of a preferred embodiment of the notebook organizer in place in a multiple ring-type agenda (not claimed)

As shown in the preferred embodiment depicted in FIG. 1, the organizer 10 has an elongated body section that is essentially flat. The body section 20 as shown in FIG. 1 is folded approximately in half such that a top element 30, bottom element 40 and crease line 43 are defined. An adhesive means 60 is impregnated on the two sides of the body sections that face each other. In a preferred embodiment, the adhesive means 60 should be a non-drying composition similar to the adhesive used on Post-It® Notes.

In this preferred embodiment, any loose notes, pieces of paper or other similar items may be held in place by separating the top and bottom elements, attaching the note or other item to either the top or bottom element adhesive means, and resealing the top element 30 to the bottom element 40. The note is held in place as long as the user wishes to maintain the note in that position. However, the user can also easily remove or reposition the note by simply separating the top and bottom elements, removing the note, or repositioning the note, and then resealing the top and bottom elements together again.

As shown in FIG. 1, the body piece is folded such that a crease line 43 is formed along the bottom edge of the organizer. However, the body piece may be folded such that the crease line 43 is formed along the top edge of the organizer. Both embodiments provide equal utility as a note organizer. While the body section 20 of the organizer 10 shown in FIG. 1 is folded approximately in half, the top element 30 need not be the same size or approximately the same size as the bottom element 40. In other preferred embodiments, the organizer 10 may have a top element that is only one half to three quarters the length of the bottom element 40. However, in these preferred embodiments, the organizer 10 will have less of an area to maintain loose notes in an observable location within the agenda.

To prevent the two sides of the body section 20 from inefficiently attaching to each other, a non-porous protective strip 50 may be placed between the top and bottom segments. In a preferred embodiment, the protective strip 50 may be a plastic material or teflon-type material to which the adhesive means 60 does not substantially adhere. The protective strip 50 is not attached to the body section 20, so that if notes or items cover the length of the body section 20, the entire adhesive area is usable.

As further shown in FIG. 1, the bottom element of the body section has an extended side segment 41 within which a plurality of holes are punched to permit the insertion of the organizer into the rings of the notebook. In various preferred embodiments, the organizer 10 may be manufactured with the extended side segment 41 having holes therein to fit two-ring, three-ring, or other multiply ring-type notebooks or agendas.

Figure 2:
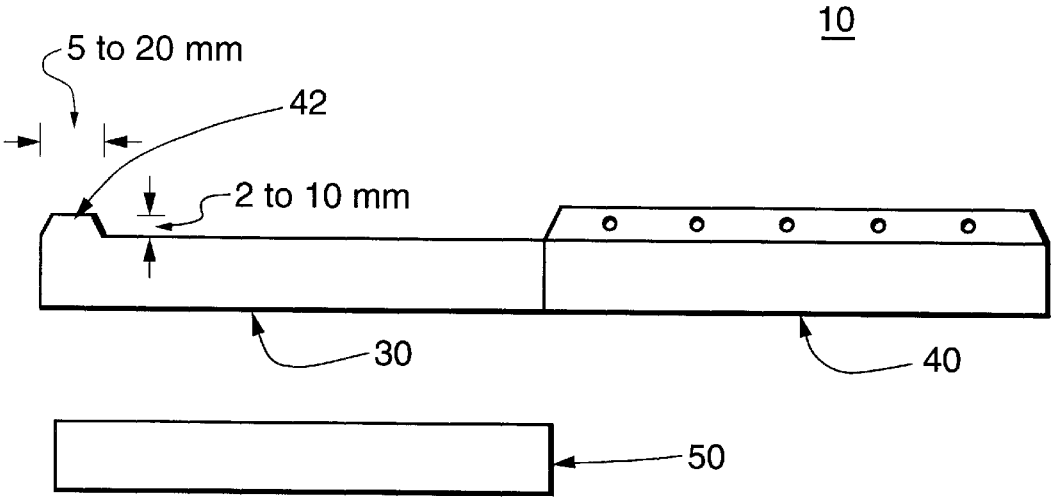
FIG. 2: is a top view of a preferred embodiment of the notebook organizer.

During repeated use of the organizer 10, and the repetitive separation of the top element 30 from the bottom element 40, the adhesive 60 may become less effective as a result of the oils in the user's fingertips collecting on the top and bottom elements. To reduce or eliminate this effect of "wear and tear," a tab segment 42 may be incorporated into the top element 30 as shown in FIG. 1. The tab segment 42 does not have any adhesive means 60 impregnated into it. To permit ease of grasping the tab segment 42 with one's fingers without touching the adhesive sections of the top or bottom elements, the tab segment 42 is appropriately sized. As shown in FIG. 2, it has been found that a tab segment 42 fabricated in the range of 5 millimeters to 2 centimeters along the length of the top element 30, and 2 millimeters to 1 centimeter in width works effectively.

Figure 3:
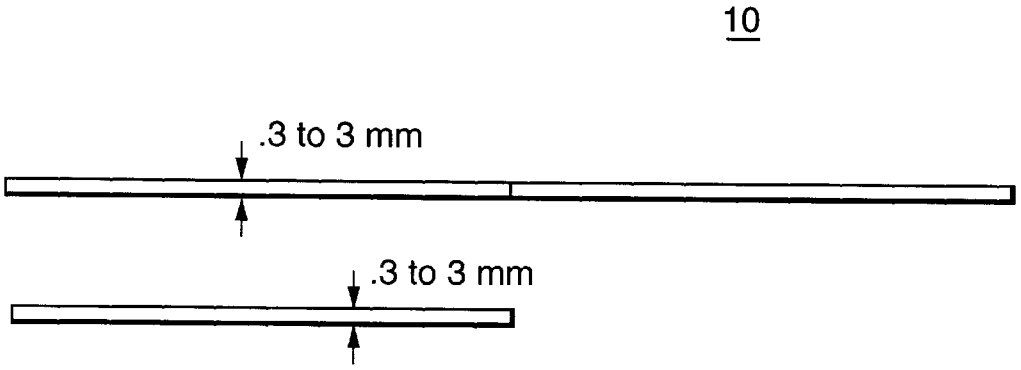
FIG. 3: is a side view of a preferred embodiment of the notebook organizer.

The body section 20 in one preferred embodiment may be made of a flexible polymer material. However, in a further, more durable embodiment, the body section 20 may be made a flat plastic material. In this preferred embodiment, the thickness of the plastic material should be within the approximate range of 0.3 millimeters to 3.0 millimeters, as illustrated in FIG. 3. In both of the above preferred embodiments, the protector piece 50 may be made of a flexible polymer material similar to the body section 20.

For decorative, aesthetic, or simply marketing appeal, the body section 20 of the organizer 10 may, in another preferred embodiment, be printed or embossed with an ornamental design, name, logo or other type of mark. Educational institution affiliation or business affiliation may be exhibited by imprinting or embossing the organizer 10 with a particular school's, or business' logo or name. Similarly, the user may wish to have his or her name and/or address imprinted or embossed into the organizer 10 as a means of identification in the event that his or her notebook or agenda is misplaced. With this identification mark, the notebook or agenda has a greater chance of being returned to the rightful owner.

The above detailed description teaches certain preferred embodiments of the present inventive notebook organizer. While preferred embodiments have been described and disclosed, it will be recognized by those skilled in the art that modifications and/or substitutions are possible and such modifications and substitutions are within the true scope and spirit of the present invention. It is likewise understood that the attached claims are intended to cover all such modifications and/or substitutions.

What is claimed is:

1. A device to organize and hold loose papers in ring-type notebooks and binders, said device comprising:

an elongated body piece folded approximately in half, thereby defining a bottom and top segment;

said bottom segment having an extended side segment with a plurality of holes punched therein through which the notebook rings fit;

adhesive means applied to the side of the bottom segment facing the top segment;

adhesive means applied to the side of the top segment facing the bottom segment;

protective means removably inserted between the adhesive side of the bottom segment and adhesive side of the top segment; and a tab incorporated into the top segment to permit ease of separation of the top segment from the bottom segment.

2. An organizer for use in notebooks or binders, said notebooks or binders having a plurality of openable and operable rings, said organizer comprising:

a flat, two-sided first segment;

a flat, two-sided second segment, said second segment being attached along one edge to an edge of the first segment, wherein the second segment is folded on top of the first segment;

adhesive means affixed to the side of the first segment opposing the second segment;

adhesive means affixed to the side of the second segment opposing the first segment;

a removable protector placed between the adhesive sides of the first and second segment;

a tab incorporated into the top edge of the second segment; and means to insert and maintain the organizer in the notebook or binder operable rings.

3. An organizer for holding loose papers within multi-ring notebooks comprising: an elongated flat body, said elongated body having a reusable adhesive impregnated on one side of said elongated body; said elongated body being folded approximately in half wherein the adhesive side of said elongated body is folded onto itself; said elongated body further having a plurality of holes punched therein through which the notebook rings may pass therethrough; said elongated body also having a tab at one end of the elongated body for ease of separation of the elongated body from itself; and a flat protector piece removably placed between the adhesive sides of the elongated body.

4. The device of claim 1, wherein the elongated body piece is a flat and flexible polymer material.

5. The device of claim 1, wherein the elongated body piece is a flat plastic material.

6. The device of claim 1, wherein the protective means is a flat and flexible polymer material.

7. The device of claim 1, wherein the protective means is a flat plastic material.

8. The device of claim 1, wherein the protective means is a flat and flexible polymer material have a thickness approximately in the range of 0.3 millimeters to 3.0 millimeters.

9. The device of claim 1, wherein the tab has a length approximately in the range of 2 millimeters to 2 centimeters and a width of 1 millimeter to 5 millimeters.

10. The device of claim 1, wherein the bottom side segment has two holes incorporated therein for use with two-ring binders.

11. The device of claim 1, wherein the bottom side segment has three holes incorporated therein for use with three-ring binders.

12. The device of claim 1, wherein the bottom side segment has a plurality of holes incorporated therein for use with binders having more than three rings.

13. The organizer of claim 2, wherein the first segment and second segment are attached along their respective bottom edges.

14. The organizer of claim 2, wherein the first segment and second segment are attached along their respective top edges.

15. The organizer of claim 1, wherein the elongated body piece is printed with an ornamental design.

16. The organizer of claim 1, wherein the elongated body piece is embossed printed with an ornamental design.

* * * * *